United States Patent [19]

Riles

[11] Patent Number: 4,669,918

[45] Date of Patent: Jun. 2, 1987

[54] OFFSHORE PLATFORM CONSTRUCTION INCLUDING PREINSTALLATION OF PILINGS

[76] Inventor: William G. Riles, 12335 Gladewick, Houston, Tex. 77077

[21] Appl. No.: 826,077

[22] Filed: Feb. 4, 1986

[51] Int. Cl.[4] ..... E02D 5/00; E02D 5/74; E02D 21/00

[52] U.S. Cl. ..... 405/227; 405/203; 405/224

[58] Field of Search ..... 405/195, 203–205, 405/208, 224–228; 114/264, 265

[56] References Cited

U.S. PATENT DOCUMENTS

| | | | |
|---|---|---|---|
| 2,651,181 | 9/1953 | Alcron et al. | 61/63 |
| 3,224,204 | 12/1965 | Sieberhausen | 405/227 |
| 3,347,053 | 10/1967 | Manning | 405/227 X |
| 3,496,728 | 2/1970 | Slack | 405/224 X |
| 3,512,811 | 5/1970 | Bardgette et al. | 405/227 X |
| 3,528,254 | 9/1970 | Graham | 405/225 X |
| 3,756,033 | 9/1973 | Kouka | 405/227 |
| 4,069,683 | 1/1978 | Jansz | 61/98 |
| 4,102,143 | 7/1978 | Phares et al. | 405/227 |
| 4,109,476 | 8/1978 | Gracia | 405/203 X |
| 4,128,008 | 11/1978 | Dixon | 405/207 |
| 4,147,036 | 4/1979 | Worrell et al. | 405/205 |
| 4,260,291 | 4/1981 | Young et al. | 405/205 |
| 4,344,721 | 8/1982 | Goldsmith | 405/224 |
| 4,378,179 | 3/1983 | Hasle | 405/227 |
| 4,388,024 | 6/1983 | Dysarz | 405/227 X |
| 4,417,831 | 11/1983 | Abbott et al. | 405/227 |
| 4,421,438 | 12/1983 | Abbott et al. | 405/227 |
| 4,426,173 | 1/1984 | Richart et al. | 405/195 |
| 4,428,702 | 1/1984 | Abbott et al. | 405/202 |
| 4,468,157 | 8/1984 | Horton | 405/224 |
| 4,537,533 | 8/1985 | Hampton | 405/227 |

FOREIGN PATENT DOCUMENTS

| | | | |
|---|---|---|---|
| 2054710 | 2/1981 | United Kingdom | 405/227 |

*Primary Examiner*—Cornelius J. Husar
*Assistant Examiner*—Nancy J. Stodola
*Attorney, Agent, or Firm*—Vaden, Eickenroht, Thompson & Boulware

[57] ABSTRACT

A method of constructing a fixed offshore platform is disclosed using a template to locate the piling locations, the template having openings for the pilings. The pilings are then driven in so that the top of each piling is above the template and about five feet above the mudline. An acoustic transponder is then used to more precisely locate each of the tops of the pilings so that the jacket to be installed thereon will be level. The jacket is installed on the pilings using a stabbing connection. The compression loads are preferably established on metal-to-metal contact bearing surfaces. The tension loads are carried by conventional grouting between the jacket legs and the piling or via a mechanical latching mechanism, which may be either external or internal. If skirt pilings are to be employed in addition to the "main" pilings, a template insert can be used with each main piling opening or sleeve in the template, if desired. The pilings for a large platform wherein its pilings are spread out over a large area can be located by using a template which is a fraction of the whole. In such case, some of the pilings are initially located and then the template is repositioned to locate additional pilings. The template is then repeatedly moved until all of the pilings are fully located.

14 Claims, 16 Drawing Figures

FIG. 2
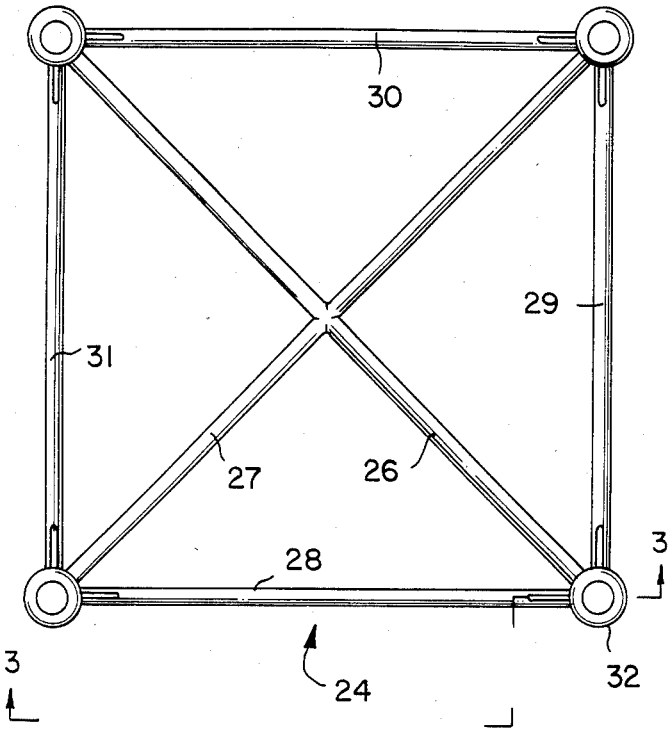
FIG. 4
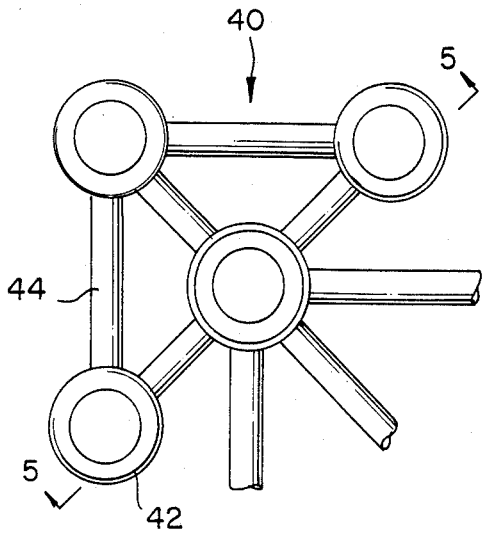
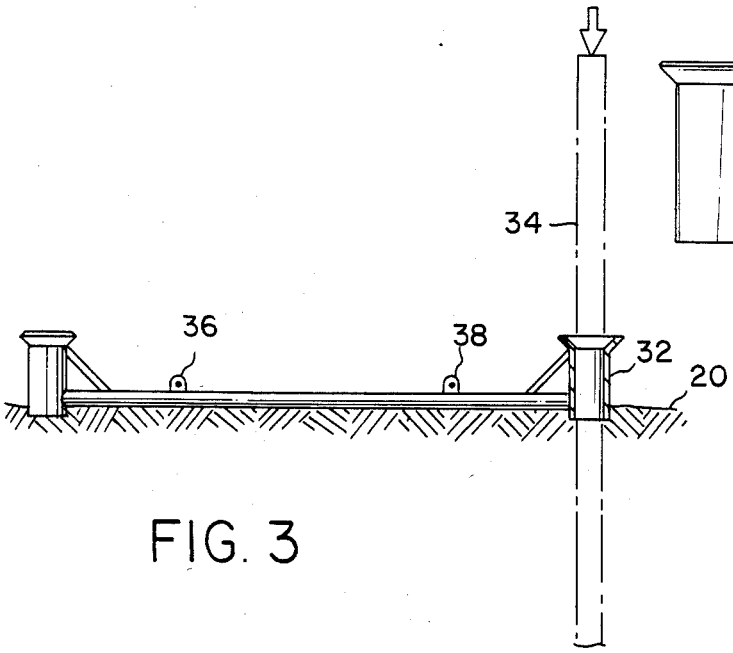
FIG. 3
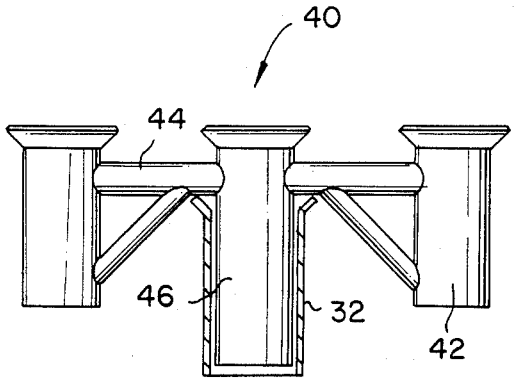
FIG. 5

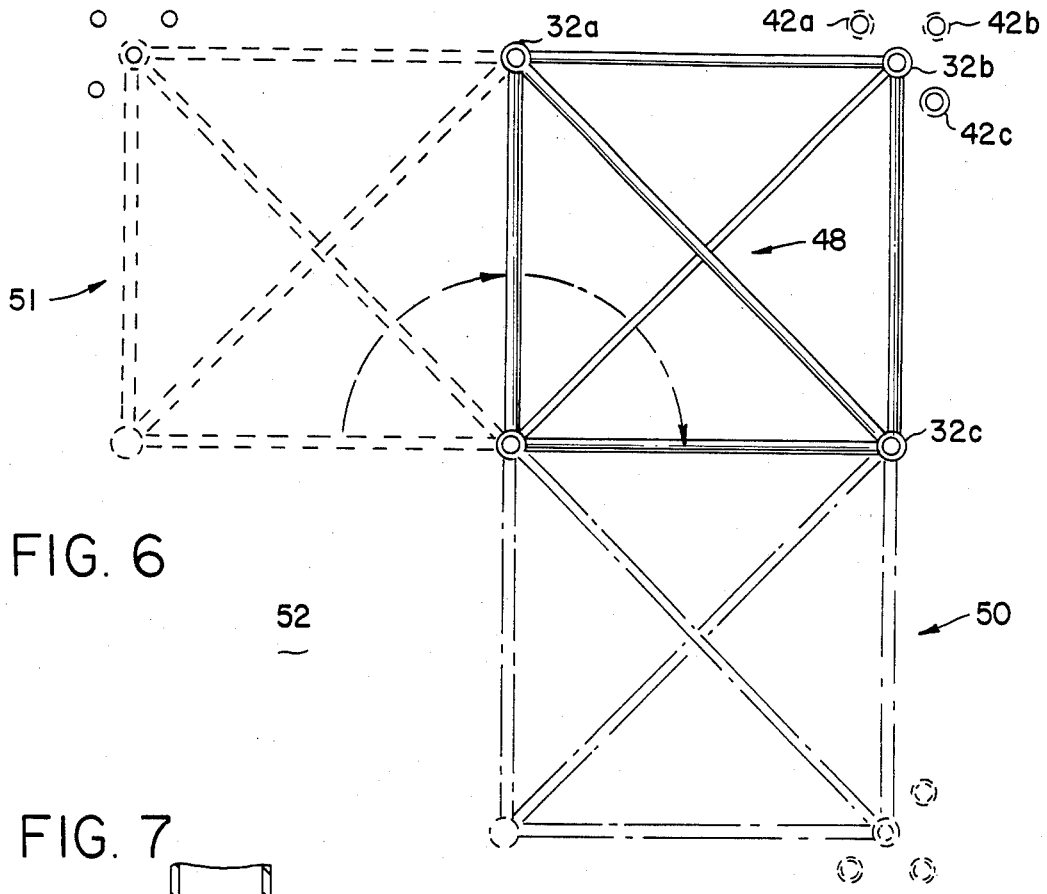
FIG. 6
FIG. 7
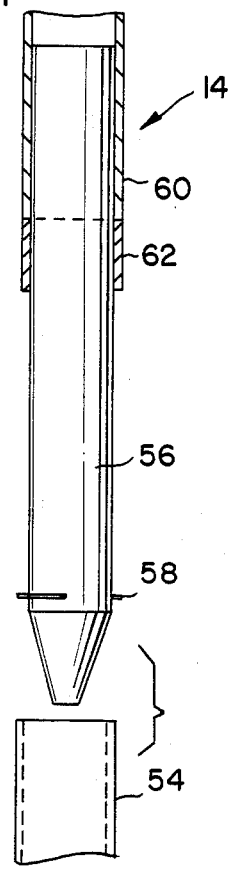
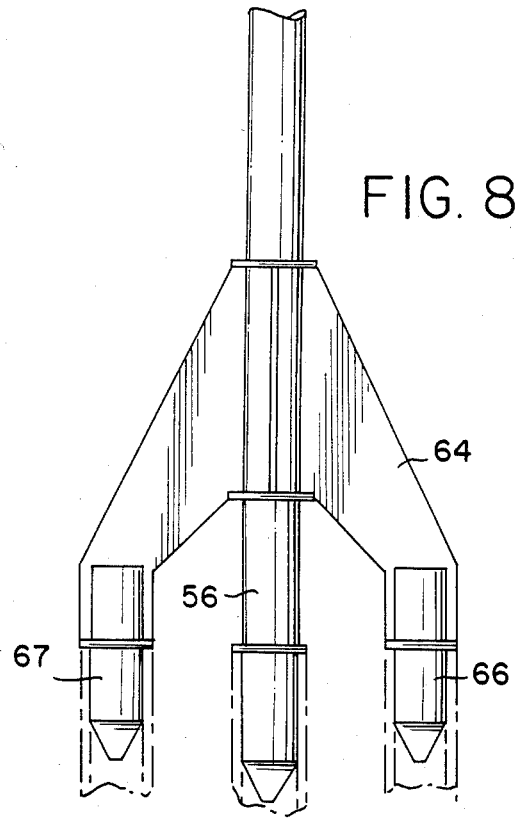
FIG. 8

OFFSHORE PLATFORM CONSTRUCTION INCLUDING PREINSTALLATION OF PILINGS

BACKGROUND OF THE INVENTION

1. Field of the Invention

This invention pertains to fixed offshore platform construction and installation and, more specifically, to a simplified method of installing fixed offshore platforms using a preinstalled piled foundation, thereby avoiding the use of jacket legs and skirt pile sleeves as templates for guiding the placement of the pilings.

2. Description of the Prior Art

Offshore platforms can be roughly categorized as being submersible, semisubmersible, jackup and fixed. Although they all have their advantages and advocates, the fixed platform construction is in widespread use. That is true even though in many deeper water installations, the materials and the installation procedures are both quite expensive.

Although there are many variations, the conventional installation procedure begins with the placement of the jacket. The jacket is a tubular framework which includes a plurality of sleeves, some of which are used for guiding the pilings during installation. In addition, the jacket includes a mudmat portion which is the horizontal support framing that forms a stable base for temporarily supporting the jacket vis-a-vis the mudline or seabed during installation. The jacket structure has a vertical dimension sufficient to allow its bottom to rest on the sea bed where the mudmats are located so that its top section will be several feet, usually 10–15 feet, above the waterline. If the distance between seabed and waterline is several hundred feet, then the jacket is several hundred feet tall.

The legs of the jacket are tubular sleeves. The main pilings are driven through these sleeves, which are located at the corners and sometimes between the corners of the jacket so as to establish a firm foundation anchored into the subterrain or geological formation under the mudline. It will be seen that if the sleeves are hundreds of feet long, then the main pilings will have to be a great deal longer to permit the pilings to pass through the sleeves and then extend a great distance into the subterrain. The jacket may also include additional sleeves that do not come all of the way to the waterline for accepting skirt pilings. Such pilings are sometimes necessary to add additional support for the jacket and in many cases the skirt pile sleeves are 100 feet long or more above the mudline.

The main pilings and the skirt pilings are then grouted through the annulus of the jacket sleeves. The grouting is conventionally a cement slurry without aggregate that is fed through appropriate tubular conduits to seal the jacket sleeves to the pilings. Finally, the deck is installed to the top of the jacket, typically by welding. It may be seen that both the compression load and the tension load on the platform resulting from wave and wind action and structural and equipment weight will be carried by the grouting.

As mentioned previously, the jacket structure can be enormous in size for installations made in deeper water. Such a jacket is normally fabricated shoreside and includes at least temporary bulkheading of the sleeves so that the structure can be made buoyant. Hydraulic tubing and valving is also provided. Typically, the larger sized jacket is towed on its side on a barge to the installation site, then launched from the barge, and via the valving, the structure is selectively flooded so that the jacket turns and descends to its installed position. The pilings are then driven into place. When the pilings are driven through the jacket legs or skirt pile sleeves, the bulkheading included in the legs or sleeves is penetrated and destroyed.

It should be noted that the dimensional requirements for the framework of the jacket is determined for deep-water installations primarily by the foundation anchoring requirements caused by the soil and the geological conditions at the site, not by the water depths or the current conditions. That is, the foundation stability requirements usually require larger piling sleeve diameters than would be required merely to support the platform and the platform load in the presence of the water conditions.

To further demonstrate the approximate magnitude of exemplary prior art installations, at least one installation, the Exxon Hondo installation, utilized a jacket that was so long, approximately 850 feet, that it was not practical to fabricate the jacket totally in one piece at that time at a shoreside location. The jacket was made in two parts, each over 400 feet long, and the two pieces were separately towed to the installation location. Here, the legs or the sleeves were mated and welded while the jacket parts were in their floating positions. Then, the jacket was selectively flooded in the manner described above so that it descended to its installed position.

The Shell Cognac jacket structure was made in three sections since this installation required a jacket length of over 1,000 feet. The lower segment was installed so as to form a permanent template for the pilings. The pilings were then driven through the jacket legs of this structure and grouted. The grouting alone filled the annulus around the pilings up through the sleeve in the lower segment. Then the second segment was positioned and mechanically connected to the first and then the top section or segment was positioned and mechanically connected to the second segment. Pin piles were inserted and grouted to connect the second segment to the first segment and to connect the third segment to the second segment. Then the deck was installed on the top of the jacket in conventional fashion. Again, the grouting carried the entire compression and tension loads.

Main pilings extending above the water line are not typically employed in deeper water installation, such as the Shell Cognac installation. The skirt pilings that are employed in the lower jacket segment of these so-called "tower" platforms do extend above the mudline at least about 100 feet or more, however.

Another prior art tower platform that is known is the Shell Bullwinkle platform. This structure is being installed in 1,400 feet of water using a conventional one-piece jacket, but no main pilings. Instead, the jacket includes sleeves for accepting 28 skirt pilings of significant length.

Another procedure to that described above is described in U.S. Pat. No. 3,528,254, J. R. Graham, issued Sept. 15, 1970. This patent shows a structure that is basically a mobile system which is at least semi-permanently installed. In this structure, a permanently installed jacket is employed which does not reach all of the way to the waterline, but to a fixed distance below the waterline. The vertical column members attached to the decking are positioned with respect to the top of the jacket and secured by a locking arrangement, best shown in FIG. 7. It should be noted that the piling below the locking arrangement is grouted in conventional fashion. When movable platform structure 15 is to be removed, the locking arrangement permits this. The jacket is then abandoned since it is permanently installed and the movable structure is towed to a new location where a similar jacket has already been preinstalled. It should be noted that the top of the jacket at the new location must be approximately the same distance below the waterline as the top of the jacket at the first location in order for platform deck height to be properly vertically positioned.

It is believed that were this feature ever utilized, the jacket also would have to be removed or destroyed since it could not be left in place to be a hidden hazard to shipping.

Therefore, it is a feature of the present invention to provide an improved method of constructing an fixed offshore platform using a preinstalled piled foundation.

It is another feature of the present invention to provide an improved method of installing a fixed offshore platform, which avoids using a jacket as a template for locating and guiding the pilings.

It is still another feature of the present invention to provide an improved method of installing a fixed offshore platform which eliminates many of the components of conventional fixed offshore platform foundations, such as mudmats and skirt pile sleeves.

It is still another feature of the present invention to provide an improved fixed offshore platform which eliminates the need for oversizing the support structure to conform to piling size necessary for soil conditions, making it only necessary to size the support structure to conform to the stresses applied to the structure because of water and wind environmental conditions and because of the mass of the deck and equipment carried by the platform.

It is still another feature of the present invention to provide an improved fixed platform structure which can be reused and which is not partly bulkhead damaged, so that its vertical columns can readily be rendered buoyant for removal and towing purposes.

It is still another feature of the present invention to provide an improved fixed platform structure that can be comparatively easily removed so that the remaining structure is not potentially hazardous to shipping and the like.

SUMMARY OF THE INVENTION

The preferred method of installing a fixed offshore platform according to the present invention begins with locating the site for each of the main tubular pilings at the mudline by employing a suitable means, such as a template that has an appropriate opening for each of these pilings. The template has a small vertical dimension of only about one or two feet. The template can be horizontally large enough to have position openings for all of the pilings. However, alternatively, a template can be used for locating a fractional part of the entire foundation layout in the below-described manner and then repeated in its use at additional fractional locations until the entire foundation area is covered. In either case, the use of such a template eliminates the use of a jacket with appropriate legs or sleeves for locating and installing the pilings.

The "main" pilings, which are elongate tubular members, are vertically driven into the template openings until they are firmly set in the formation beneath the mudline. Hence, the relative horizontal position of the pilings is provided by the template. The top of the pilings are established about 5 feet above the mudline and are vertically adjusted with respect to one another by suitable means, preferably by using acoustic transponder techniques to determine the relative height locations. Hence, the relative elevations of the tops of the pilings are established so that the jacket which is subsequently installed will be level. Spacers can be provided on the jacket legs so as to provide additional means for adjusting and levelling the position of the jacket. The template can be removed by slipping it over the top of the pilings, which can be done, if preferred, before the transponder leveling procedure mentioned above.

A space-frame jacket is then installed on the top of the pilings using a stabbing connection at each of the pilings. The stabbing part of the connection can be a male extension of the jacket leg. However, the piling may slip into a sleeve of the jacket, in which case there is still a "stabbing connection", the piling acting to stab the jacket.

The pre-installed pilings provide immediate vertical support to the jacket thus eliminating the need for mudmats and horizontal framing at the jacket's base.

In a preferred embodiment, a jacket leg for each piling includes an extension that enters its respective piling until the top of the piling comes to rest on a bearing surface. Hence, the compressive load is carried by metal-to-metal contact at this point. The annulus between the piling and the jacket leg extension can also be grouted to form the load transfer mechanism. However, alternatively, if preferred, a bearing ring and mechanical connector is employed to carry these loads, thereby eliminating the use of grouting altogether as a load transfer mechanism. The deck legs are then welded to the top of the jacket in conventional fashion.

If skirt pilings are required for a particular installation, a secondary template can be used at each main piling opening in the template to locate these secondary or auxiliary pilings. As with the main template, the secondary template is readily removed after the skirt pilings are installed.

It should be noted that using the above procedure permits the design of the piling configuration to be established with only the soil conditions of the geological formation in mind and the jacket to be designed only with the water and wind environmental stresses and load conditions in mind. That is, the main jacket legs and jacket sleeves through which piles are conveniently installed do not have to be artificially large to accommodate large piling diameters that might be required because of soil conditions. A reduction in size also results in a reducing of wave loadings and thus further reduces the structural and foundation requirements. Moreover, a by-product of a reduced framing size, other than just reducing the amount of metal required, is the reduction of cathodic corrosion protection required for the reduced metal content.

Furthermore, since the legs of the jacket are not used to accept and guide the pilings, bulkheads included therein for purposes of making the jacket buoyant for transport and installation purposes are not destroyed. Hence, the jacket can be relatively easily salvaged and rendered buoyant in the event of reuse.

Finally, should the jacket ever be removed for salvage purposes, or to be used at another well location, there is no potentially hazardous structure left in place which rises to only a few feet underneath the waterline.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the drawings, which drawings form a part of this specification. It is to be noted, however, that the appended drawings illustrate only preferred embodiments of the invention and are therefore not to be considered limiting of its scope, for the invention may admit to other equally effective embodiments.

In the Drawings

FIG. 2 is a plan view of a four piling template in accordance with the present invention.

FIG. 3. is a side elevation view of the four piling template shown in FIG. 2.

FIG. 4 is a plan view of a piling insert template for locating skirt pilings, in accordance with the present invention.

FIG. 5 is a side elevation view of the piling insert template shown in FIG. 4.

FIG..6 is a plan view of a quarter-placement template in accordance with the present invention.

FIG. 7 is a partial view of a jacket leg, spacer and male extension with respect to stabbing the top of a piling in accordance with the present invention.

FIG. 8 is a partial side view of the male extension of a jacket leg adapted for stabbing skirt pilings in addition to a main piling in accordance with the present invention.

Figure 9:
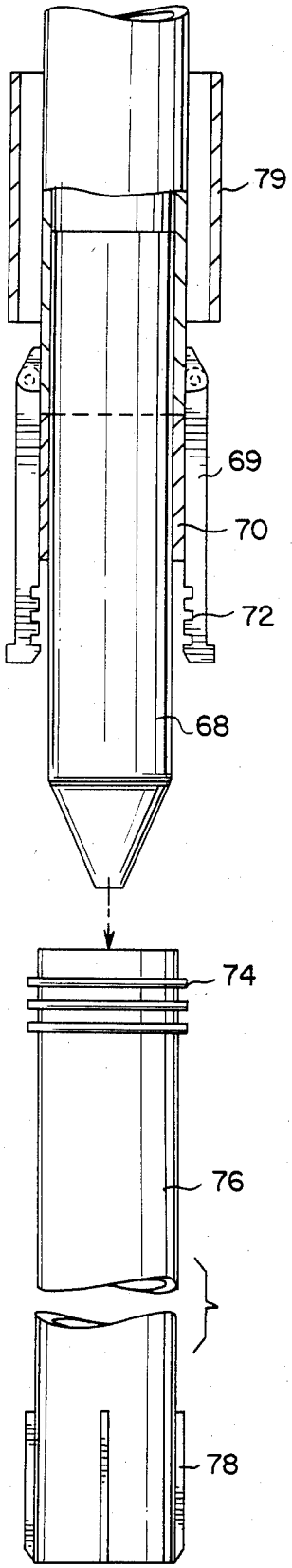

FIG. 9 is a partial side view of a locking mechanism of a preferred embodiment of the present invention for attaching a jacket leg to a piling.

Figure 9A:
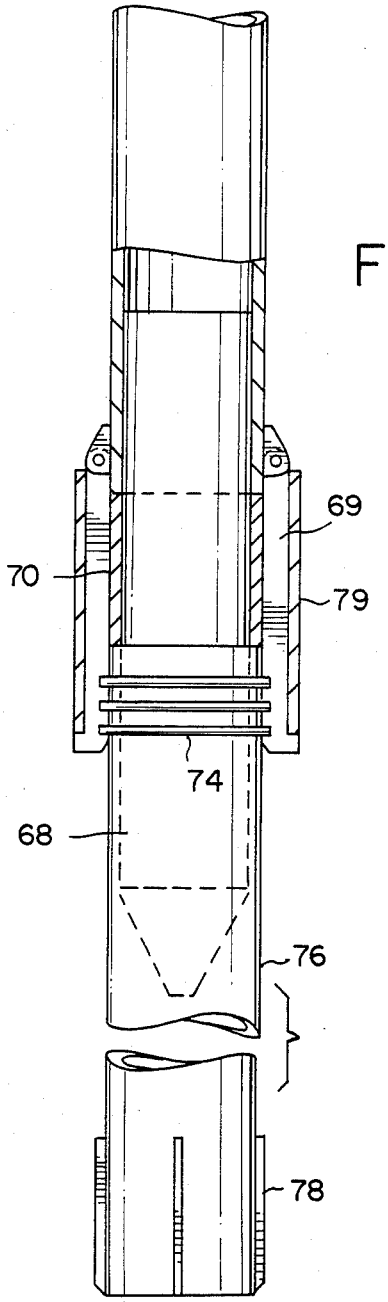

FIG. 9A is a partial side view of the locking mechanism shown in FIG. 9 after it has been locked in place to the top of a piling.

Figure 10:
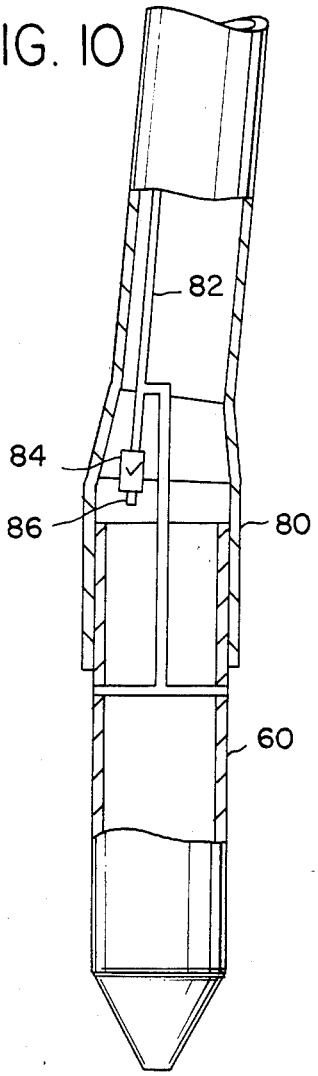

FIG. 10 is a partial side view of a lower jacket leg elbow and the top of a leg extension, also showing a grouting line, for another preferred embodiment of the present invention.

Figure 11:
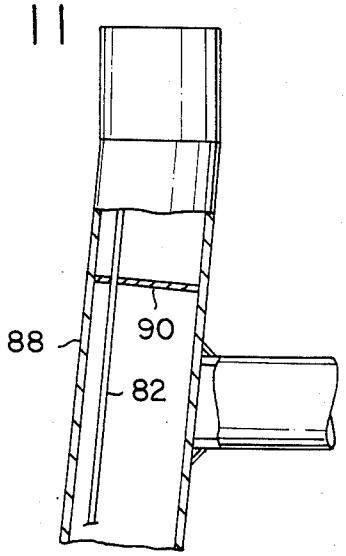

FIG. 11 is a partial side view of an upper jacket leg elbow in accordance with the present invention.

Figure 12:
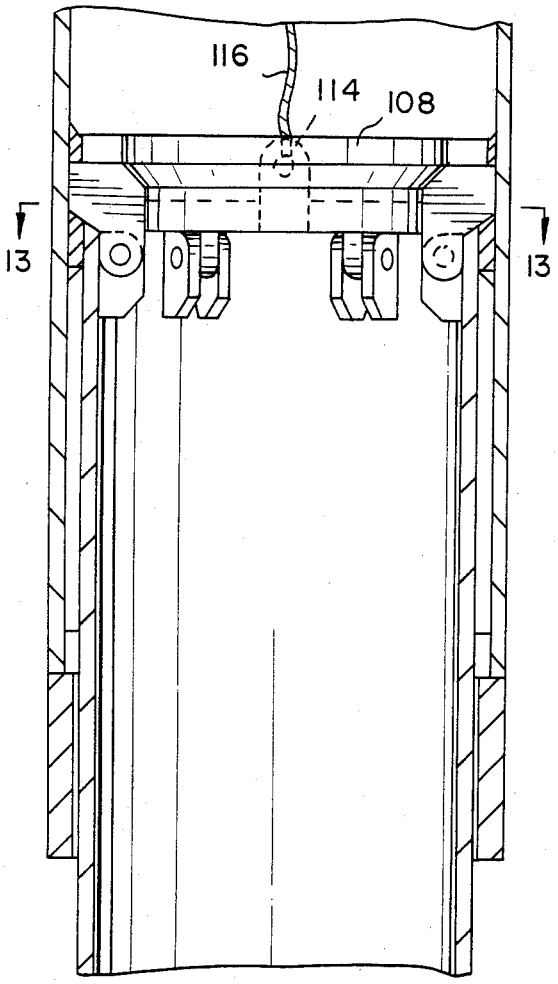

FIG. 12 is a partial side view of another preferred locking mechanism of the present invention for attaching a jacket leg to a piling and which includes a release mechanism.

Figure 13:
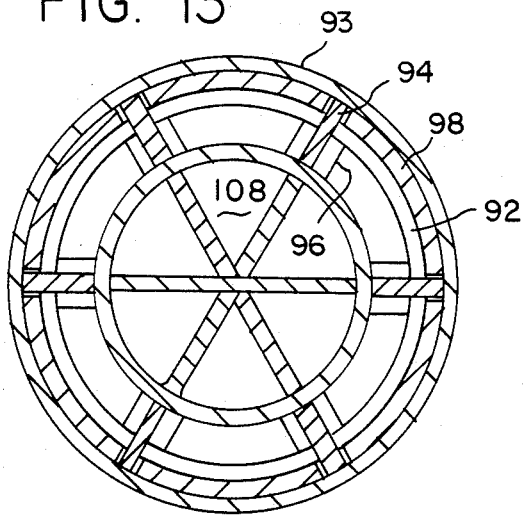

FIG. 13 is a cross-sectional view taken at 13—13 of FIG. 12.

Figure 14:
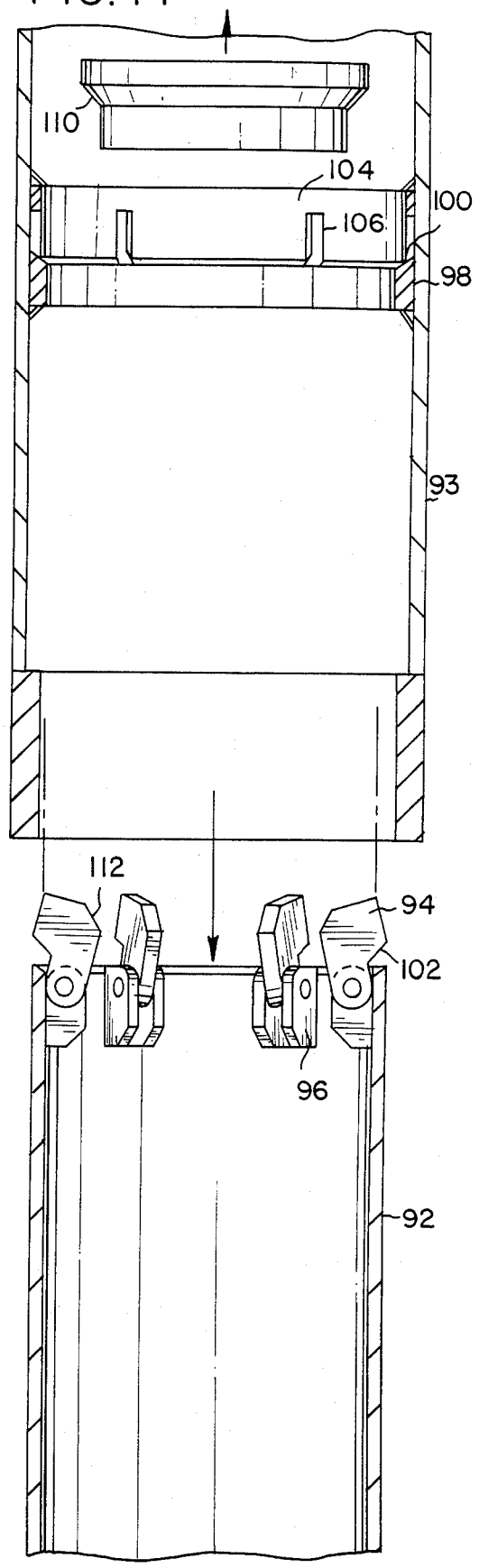

FIG. 14 is a partial side view of the locking mechanism shown in FIGS. 12–13 following locking release.

DESCRIPTION OF THE PREFERRED EMBODIMENTS

Figure 1:
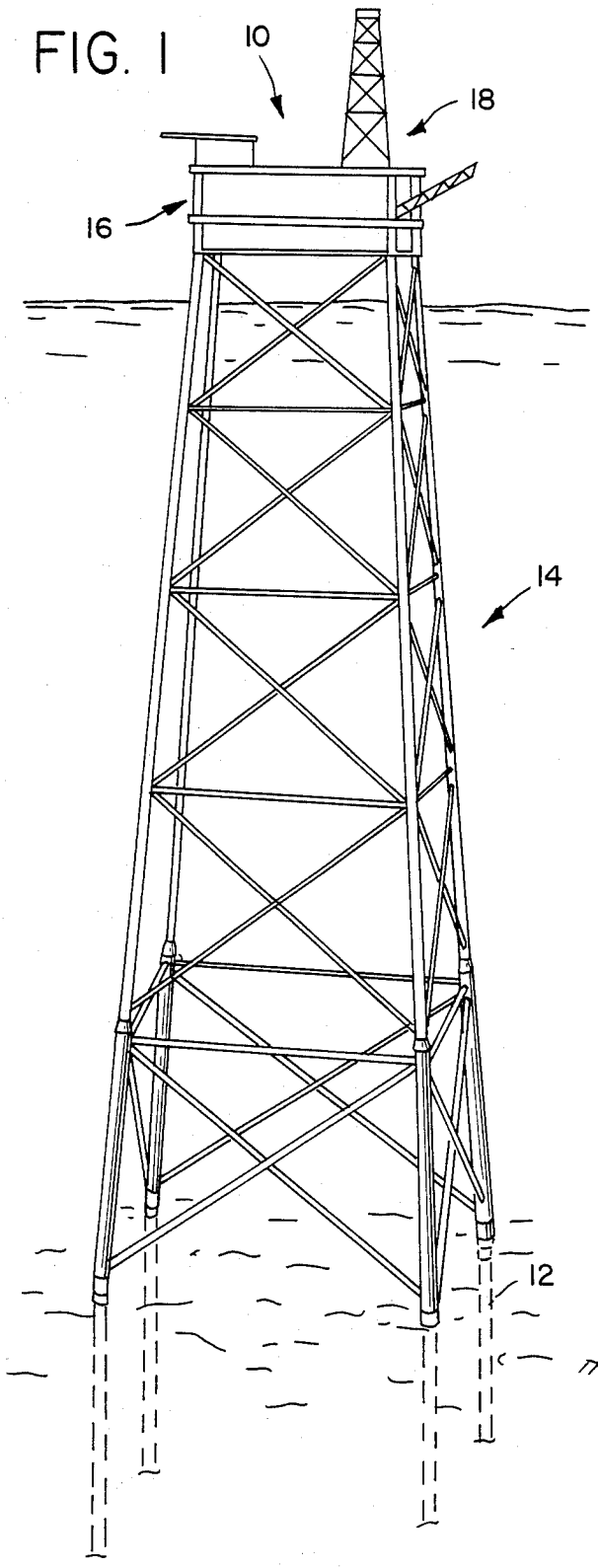
FIG. 1 is an isometric view of a fixed offshore platform construction in accordance with the present invention showing the piling, jacket and deck construction elements in schematic form.
Figure 1A:
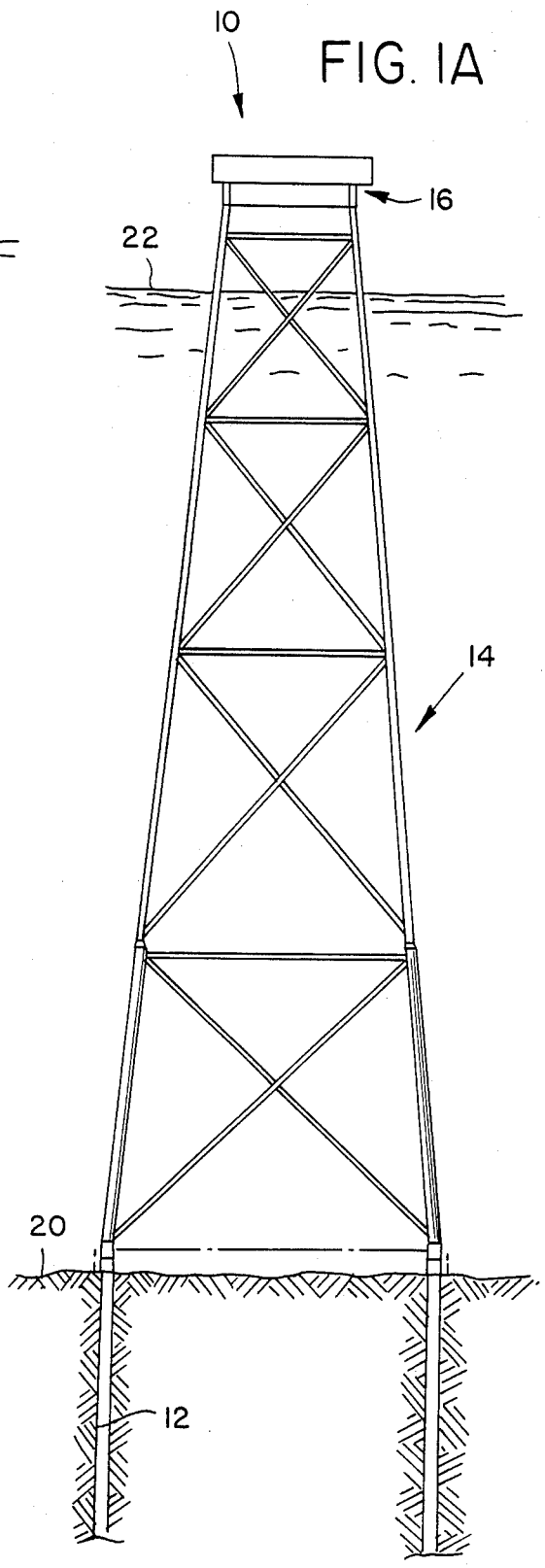
FIG. 1A is a side elevation view of the fixed offshore platform shown in FIG. 1.

Now referring to the drawings and first to FIGS. 1 and 1A, a fixed offshore platform 10 installed in accordance with the present invention is shown. The platform generally comprises main pilings 12, jacket 14 secured thereto in a manner hereafter explained, and deck 16 installed to the top of the jacket in conventional fashion. The appropriate drilling and/or production equipment 18 is supported by the decking. Mudline or seabed 20 is such that the tops of the pilings are located approximately five feet or so above the mudline. Waterline 22 may be several hundred feet above mudline 20 and is located below deck 16. It should be noted that a portion of jacket 14 also extends above waterline 22. Of course, the waterline may rise and fall with the tides or be subject to wave action, but the waterline would always be such that equipment 18 would not be subject to flooding.

Now referring to FIGS. 2 and 3, a substantially two-dimensional template 24, compared with prior art jacket template structures, is shown which generally comprises a tubular framework. This tubular framework includes cross pieces 26 and 27 and peripheral pieces, 28, 29, 30 and 31. Located at each of the corners is a sleeve 32, which has a central opening for guiding a piling 34, as shown in FIG. 3. As best shown in FIG. 3, the template has a small vertical dimension, the tubular diameter being typically about 20 inches and the sleeve height being only about 10 feet.

Template 24 is shown in its most simple form in FIG. 2 wherein there is a sleeve 32 located in each of the four corners of a square configuration. In actual practice the structure may include more than four sleeves and the template may be rectangular or have some other configuration than square.

Referring again to FIG. 3, cross-sectional pieces 26 and 27 and/or side pieces 28–31 can conveniently have welded thereto appropriate lifting rings or eyes 36 and 38. These rings permit the template to be lowered into position from the surface to the appropriate location on mudline 20 prior to use. Please note that the sleeves and the tubings may embed slightly into the surface of mudline 20 if the soil conditions are soft; however, the top of each of the sleeves will still be readily visible and available to receive the pilings.

Pilings 34 are driven through template sleeves 32 by pile driving techniques well-known in the art to provide an anchor for the foundation of the entire platform. The length of the pilings and their diameters are dependent upon soil and geological conditions underneath mudline 20. However, in any event, the top of the pilings are driven so that they are only slightly above the top of sleeve 32. If a technique is employed for horizontally locating the piling which does not require a template at all, then the top of the pilings will only be exposed about five feet above the mudline.

The top of the pilings are height adjusted so that they are approximately level with one another for receipt of the jacket to be explained below. Such leveling is measurable by acoustic transponder techniques or equivalents, which techniques are well-known in the art. The height of the piling is established by driving the pilings to their respective heights by the use of sizing of spacers and/or by the trimming of spacers that are subject to such adjustment.

Referring now to FIGS. 4 and 5, an appropriate template insert 40 is shown for purposes of providing template skirt sleeves 42 which are similar to main piling sleeves 32 of the template previously described. The template insert shown in FIGS. 4 and 5 include three such template skirt sleeves interconnected with one another by appropriate tubular pieces 44 and to a sleeve insert 46. In use, sleeve insert 46 slips into sleeve 32 and locates each of template skirt sleeves 42 with respect thereto. In addition, sleeve insert 46 is hollow so that when skirt pilings are desired, it is first located in insert 32 before any of the pilings are driven. That is, the insert is first positioned into the main template sleeve 32 and then main piling 34 is driven through both insert 46 and concentric sleeve 32 followed by the driving of skirt pilings through each of template skirt sleeves 42 in the manner previously discussed.

A skirt sleeve template can include openings not employed for a particular installation. To avoid inadvertent usage, such openings or sleeve guides not to be used can be conveniently plugged, if desired.

As mentioned previously, the template shown in FIGS. 2 and 3 is the most simple kind of template which may be set down for a platform. It may be that the platform is so large that it is not convenient to have one template locate all of the pilings. FIG. 6 shows a quarter template which can be used for locating the pilings for one-fourth of the structure at a time. It should be noted that quarter template 48 locates three main sleeves 32*a*, 32*b* and 32*c*. Further, a template skirt sleeve may be used at main sleeve 32*b* to further locate skirt sleeves 42*a*, 42*b* and 42*c* in the manner previously described. Following the use of the template to locate the pilings at the sleeves which have been indicated, the template may be removed and reestablished at each of the dotted positions 50 and 51 for locating in a similar fashion main pilings and skirt pilings as described above. Finally, the template may be rotated to fourth quadrant 52 where no dotted lines are shown for convenience of clarity of illustration to locate the final main pilings and skirt pilings, as before. Hence, it will be seen that one-quarter template 48 is used four times to locate the appropriate pilings which are required for the installation.

Alternative to picking up the quarter or other fractional template and relocating it for each placement using surveying techniques, it is possible to include one or more locator pile openings in the fractional template. In such case, the locator pile(s) provide an index for relocating the fractional template at each subsequent position.

It may be apparent that any number of combinations of appropriate templates and geometry may be employed in the fashion described in connection with FIG. 6. For instance, an elongate, rectangular construction may relocate a template in the general shape of template 48 twice. Or, the template used in FIG. 6 may be used four additional times to provide a large rectangular structure which has a length twice its width. The invention herein is not limited to either the shape of the template or the number of times it is employed to determine an overall foundation layout.

It should be further noted that the openings for skirt pilings may be included in the base or main template, either of the full template size or of the fractional size discussed above. That is, the skirt pilings do not have to be accommodated only through the use of template skirt sleeves 42.

Now referring to FIG. 7, top 54 of a piling installed in the manner just described is open to receive a male extension 56 located on the lower end of jacket 14. The lower end of male extension 56 may include a hard rubber wiper ring 58 as a convenience for sealing the annular space between the external surface of the male leg extension and the internal surface of the top of the piling. The male extension which extends into the bottom of jacket leg 60 can be permanently attached thereto by welding.

The extension can also conveniently have a spacer 62 located about the extension at a position just below the jacket leg. This spacer is useful in providing further means for leveling the jacket. Such a spacer can be welded to the jacket as a leg extension prior to installation. Thus, if the tops of the pilings have not been leveled sufficiently to accomplish absolute horizontal leveling of the jacket prior to the jacket being installed, then one or more of the jacket spacers can be cut or trimmed to achieve such vertical leveling without necessitating the removal of the jacket and relocating the top of one or more of the pilings to accomplish the same effect. In either event, the compression load is carried by the metal-to-metal contact made between the top of the piling and either the bottom of the jacket leg or by the bottom of the spacer.

Once the jacket has been installed in the manner described above in connection with FIG. 7, grouting is employed to seal the extension into the top of the piling to affect the tension connection therebetween. It should be noted that the compression connection is designed to be provided through the direct bearing surfaces of the top of the piling in conjunction with the bottom of spacer 62. As noted below, grouting can be provided and when provided can be sufficient to carry both the compression and tension loads.

The bottom jacket leg can be supported not only by a single piling as shown in FIG. 7, but by skirt pilings as previously described. In this event, and with reference to FIG. 8, the bottom part of the jacket includes not only a male extension 56 for insertion into the top of a main piling as described in FIG. 7 but also includes a male extension span 64 including additional male inserts 66 and 67 for stabbing into the top of appropriate skirt pilings. Extension span 64 is permanently welded to the extension 56 or, alternatively, to the lower part of jacket leg 60. Again, spacers can be provided to provide a leveling opportunity, if desired. Although only extensions 66 and 67 are shown in FIG. 8, another extension will be included in span 64 when the span is used in conjunction with three skirt pilings, as established by the template insert shown in FIG. 4.

Alternative to the use of a skirt spans, it is obvious that the skirt pilings can be stabbed in the same manner as the main pilings previously discussed. That is, male extensions can be framed into the jacket for each of the skirt pilings, if desired.

As mentioned above, it is conventional to employ grouting for carrying the tension load placed upon the connection between the piling and the jacket. However, it is not necessary to rely on grouting for this function. FIGS. 9 and 9A show one connection means which is appropriate to provide such a mechanical connection.

Male extension 68, which is otherwise like male extension 56 in FIG. 7, has included securely connected thereto a plurality of pivoted locking arms 69, the lower end of which extend below spacer 70. The end of arms 69 include suitable internal grooves 72 for latching onto bearing rings 74 which are permanently located on the top of piling 76. The top of piling 76 also includes below ring 74 a plurality of fins 78. It should be noted that when the structure of FIG. 9 is employed, the template sleeve will be sufficiently large to accommodate fins 78. Thus, the template sleeve opening will be sufficiently large and appropriately centered to slip over rings 74. That is, the external diameter provided by fin 78 will be slightly in excess of the external diameter of ring 74 to permit the template sleeve which is used therewith to slide over the top of the piling once the piling has been installed, in the same manner as previously discussed.

Finally, a locking sleeve 79 is provided above pivoted locking arms 69 that is sufficiently large so that it will slide down over arms 69 once the connection has been made.

In operation, male extension 68 is inserted into the top of piling 76 in a manner previously discussed for the previous embodiment the pivoted arms riding up and over ring 74 so that the internal grooves are positioned opposite such rings. Sleeve 79 is then permitted to slide down over the locking arm to secure the connection. In the connection shown, it is apparent that the tension load of the jacket with respect to the top of the piling is carried by grooves 72 and rings 74.

It should be noted that there may be more internal grooves 72 then there are locking rings so as to provide a range of connections, if desired. The completed structure that has just been described is shown in FIG. 9A.

It may also be apparent that such a locking connection provides removal of the jacket leg from the top of the piling, if desired, for relocating and reusing the jacket at a subsequent installation. That is, locking sleeve 79 may be pushed up, locking arms 69 may then be rotated outwardly to release the connection and the jacket merely pulled from the top of the pilings.

As shown in FIGS. 1 and 1A, the pilings are vertically driven in place. The jacket legs, however, may need to be conveniently at an angle to vertical. In order to provide such an interconnection, reference is made to FIG. 10. At a position of jacket leg 60 above the connection described in FIG. 7, an appropriate elbow 80 is shown on the bottom part of the jacket for providing the internal angling which is desired for the main part of the jacket thereabove. The elbow merely has a bend.

Also shown in FIG. 10 in addition to the elbow, however, is appropriate tubular conduit or line 82 leading to the surface which connects with an internal flooding valve 84 and flooding inlet 86. That is, the valve provides for flooding the jacket leg at the location indicated for purposes of overcoming the buoyancy required when transporting the jacket, previously discussed, during installation. The valve may be shut and the lines used for grouting when grouting is used for carrying the tension load between the jacket leg and the piling as previously described in conjunction with the description of FIG. 7.

At the surface prior to the installation of the deck an elbow 88, as shown in FIG. 11, may be used again for providing a vertical connection for deck connection.

The other part of the structure which is important in FIG. 11 is internal bulkhead 90 which is used for sealing the jacket leg so that it can provide the buoyancy required for transport, as previously discussed. It will be obvious that this bulkhead is not disturbed during the installation of the jacket in the manner previously discussed. That is, no piling is driven with those prior art jackets wherein a piling was driven through the entire length of the jacket leg.

Now referring to FIGS. 12–14, an alternate mechanical construction mechanism is shown for connecting the male extension to the jacket leg other than be welding as described in connection with the structure shown in FIGS. 9 and 9A. In this embodiment, the top male extension 92 is provided with a plurality of pivoted locks 94, the locks being pivoted between suitable ears 96 welded to the inside of tubular extension 92. It should be noted that when the locks are pivoted completely to be inside the surface, the top of extension 92 is flush.

Now referring to the jacket leg to which the extension is to be attached, a suitable internal lower ring 98 is provided having an upper surface 100 which is angled upwardly to the internal diameter surface of the leg 93. The ring is welded in place at this location. It should be noted that pivoted lock 94 has a mating surface 102 which rides on top of surface 100 when the connection has been completely made.

An upper ring 104 is also included inside leg 93 above ring 98 which is slotted at slots 106 for the receipt of locks 94. It will be seen that in the locked position, locks 94 are inserted within slots 106 and held in place by lock cap 108. Lock cap 108 also includes a lower beveled edge 110 at its periphery that mates with comparable upper internal beveled edges 112 on each of the pivoted locks. Hence, when cap 108 is lowered onto the locks they tend to push the locks into their locking position.

Locking cap 108 is connected at its upper end through an appropriate positioning ring or eye 114 which can be manipulated by a line 116 connected thereto.

Hence to join extension 92 to leg 93, the pivoted locks are rotated mostly in their upward position such as in FIG. 14 and the leg is lowered thereover so that the locks will appropriately lock into slots 106 and over surfaces 100. The locks are secured in place by the lowering of cap 108. To disconnect the locks, the cap is removed by an upward pull. Upward movement of the leg will then release the locks since opposing surfaces 100 and 102 are appropriately angled to permit unlocking rotation of the locks.

It will be seen that the internal locking member which has just been described cannot be fouled or otherwise tampered with externally. Hence, when it is desirable to salvage the jacket, it is possible to easily release the jacket from the extension, which would be left in place in the top of the piling.

From the foregoing it will be seen that this invention is one well adapted to attain all the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matters herein set forth and shown in the accompanying drawings are to be interpreted as illustrative and not in a limiting sense.

For example, in the above discussion it is assumed that a template will be used and removed after the pilings are pre-installed. The template could, of course, be left in position if desired. Furthermore, the pilings may be located by survey means not using a template at all. Acoustic transponder techniques provide one such means.

Further, the main pilings could be pre-installed using the above procedures and skirt pilings could be installed using jacket sleeves in conventional fashion once the jacket was in place, if desired.

What is claimed is:

1. The method of offshore platform installlation, the platform including a plurality of pilings for respectively being driven at chosen sites in the mudline, which comprises the steps of locating the site for each of the pilings at the mudline, installing the pilings by driving them into the earth beneath the mudline so that each of said pilings extends only a short distance above the mudline, and installing a space-frame jacket having depending support legs onto said pilings using stabbing connections for trasferring the compressive load of the platform by effecting metal-to-metal bearing contact between said legs of the jacket and the top of the pilings.

2. The method of offshore platform installation in accordance with claim 1, wherein the locating of the site for each of the pilings includes using a template at the mudline having a sleeve guide for locating each of the piling locations.

3. The method of offshore platform installation in accordance with claim 2, wherein the top of each of the pilings is vertically determined using acoustic transponder means.

4. The method of offshore platform installation in accordance with claim 2, wherein the locating of the site for each of the pilings uses a template that is a fractional part of an entire template layout, wherein said template is laid out for locating at least a first piling position and said template is subsequently laid out for locating at least a second piling position.

5. The method of offshore platform installation in accordance with claim 2, wherein said template locates each of said main pilings positions and including locating at least an additional skirt piling position with respect to each of said main piling positions using an insert template for fitting into said template at each of said main piling positions.

6. The method of offshore platform installation in accordance with claim 5, wherein said insert template locates a plurality of skirt piling locations by having a plurality of sleeve guides, and including plugging each of said sleeve guides not to be used for a skirt piling installation.

7. The method of offshore platform installation in accordance with claim 2, and including removing the template once the pilings have been installed.

8. The method of offshore platform installation in accordance with claim 1, and including locating the site for each of the pilings by acoustic transponder surveying.

9. The method of offshore platform installation in accordance with claim 1, and grouting said legs of the jacket to the top of the pilings for carrying compression and tension loads.

10. The method of offshore platform installation in accordance with claim 1, and including using mechanical connectors at each of said stabbing connections for transferring the tensile load of the platform by effecting metal-to-metal bearing contact between the legs of the jacket and the top of the pilings.

11. The method of offshore platform installation in accordance with claim 10, wherein said mechanical connectors include bearing rings on the outside of the pilings for transferring the tensile load.

12. The method of offshore platform installation in accordance with claim 10, wherein said mechanical connectors include an internal bearing ring between the legs of the jacket and the top of the pilings.

13. The method of offshore platform installation in accordance with claim 1, and including using a spacer in a plurality of the legs of the jacket for providing for vertical variance of said jacket legs and pilings.

14. The method of offshore platform installation in accordance with claim 1, wherein said platform includes a deck having depneding deck legs, and including installing the deck legs onto the top of the jacket.

* * * * *